US007340984B2

(12) United States Patent
Hsieh

(10) Patent No.: US 7,340,984 B2
(45) Date of Patent: Mar. 11, 2008

(54) MULTI-FUNCTIONAL HAND TOOL

(76) Inventor: Chih-Ching Hsieh, 5F.-2, No. 181, Sec. 2, Mei Tsun Rd., South District, Taichung City (TW)

( * ) Notice: Subject to any disclaimer, the term of this patent is extended or adjusted under 35 U.S.C. 154(b) by 0 days.

(21) Appl. No.: 11/332,344

(22) Filed: Jan. 17, 2006

(65) Prior Publication Data

US 2007/0163405 A1 Jul. 19, 2007

(51) Int. Cl.
*B25B 13/00* (2006.01)
*B25B 23/16* (2006.01)

(52) U.S. Cl. ..... 81/177.85; 81/125.1; 81/177.2

(58) Field of Classification Search ..... 81/177.85, 81/177.8, 125.1, 177.2
See application file for complete search history.

(56) References Cited

U.S. PATENT DOCUMENTS

| | | | | | |
|---|---|---|---|---|---|
| 759,948 | A * | 5/1904 | Weston | 81/125.1 |
| 853,930 | A * | 5/1907 | Miller | 81/60 |
| 1,323,056 | A * | 11/1919 | Hofmann | 7/138 |
| 1,578,114 | A * | 3/1926 | Fegley | 81/124.6 |
| 1,796,083 | A * | 3/1931 | Carlberg | 81/440 |
| 1,811,137 | A * | 6/1931 | Kress | 81/124.3 |
| 3,114,401 | A * | 12/1963 | Johnson | 81/438 |
| 4,056,020 | A * | 11/1977 | Coviello | 81/177.2 |
| 4,334,445 | A * | 6/1982 | Timewell | 81/177.7 |
| 4,727,782 | A * | 3/1988 | Yang | 81/124.4 |
| 5,485,769 | A * | 1/1996 | Olson et al. | 81/177.85 |
| 5,522,287 | A * | 6/1996 | Chiang | 81/60 |
| 5,568,757 | A * | 10/1996 | Lewis | 81/177.2 |
| 5,685,208 | A * | 11/1997 | Tidwell | 81/177.85 |
| 5,743,737 | A * | 4/1998 | Hawn et al. | 433/141 |
| 5,904,077 | A * | 5/1999 | Wright et al. | 81/177.9 |
| D433,295 | S * | 11/2000 | Houpe | D8/29 |
| 6,257,104 | B1 * | 7/2001 | Jarrett | 81/177.8 |
| 6,269,717 | B1 * | 8/2001 | Bollinger | 81/177.2 |
| 6,354,176 | B1 * | 3/2002 | Nordlin | 81/124.4 |
| 6,626,071 | B2 * | 9/2003 | Kesinger et al. | 81/437 |
| D510,847 | S * | 10/2005 | McKnight | D8/29 |
| 7,024,970 | B2 * | 4/2006 | Boman | 81/177.8 |
| 7,040,200 | B2 * | 5/2006 | Lin | 81/177.5 |
| 7,044,028 | B1 * | 5/2006 | Lozano et al. | 81/60 |
| 2004/0020329 | A1 * | 2/2004 | Boman | 81/125.1 |
| 2006/0230885 | A1 * | 10/2006 | Olson | 81/177.85 |

FOREIGN PATENT DOCUMENTS

| | | | |
|---|---|---|---|
| GB | 2155831 | A * | 10/1985 |
| GB | 2160137 | A * | 12/1985 |

* cited by examiner

*Primary Examiner*—David B. Thomas

(57) ABSTRACT

A multi-functional hand tool comprises a hand tool body which has a handle; each of two ends of the handle having a connecting unit for connecting various assembly so that the hand tool has various functions. At least one connecting unit is formed with a recess. At least one connecting unit is formed with a polygonal connection portion. The handle is formed with a pivotal portion. The pivotal portion is installed at one third of the handle.

3 Claims, 9 Drawing Sheets

MULTI-FUNCTIONAL HAND TOOL

FIELD OF THE INVENTION

The present invention relates to hand tools, and particularly to a multi-functional hand tool which has a handle; each of two ends of the handle having a connecting unit for connecting various assembly so that the hand tool has various functions.

BACKGROUND OF THE INVENTION

Driving hand tools, such as spanners, wrenches, are used to drive an object by rotating the object repeatedly. However in the present invention, the hand tool has a unique function which is only used with fixed type driving head. In one prior art, a spanner has a D shape ratchet spanner. The spanner can be engaged with various sockets and thus it is convenient in use. However the prior art is only used with socket, while many different assemblies cannot be used with the spanner. Thereby the function is confined in a narrow scope.

Therefore, the prior art is not practical and not useful. Thus, there is an eager demand for a novel design which can improve this prior art defect.

SUMMARY OF THE INVENTION

Accordingly, the primary object of the present invention is to provide a multi-functional hand tool which has a handle; each of two ends of the handle having a connecting unit for connecting various assembly so that the hand tool has various functions.

To achieve above objects, the present invention provides a multi-functional hand tool which comprises: a hand tool body which has a handle; each of two ends of the handle having a connecting unit for connecting various assembly so that the hand tool has various functions. At least one connecting unit is formed with a recess. At least one connecting unit is formed with a polygonal connection portion. The handle is formed with a pivotal portion. The pivotal portion is installed at one third of the handle.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4(J)4, the multi-functional hand tool of the present invention is illustrated. The multi-functional hand tool has the following elements.

A hand tool body 1 has a handle 10. Each of two ends of the handle 10 has a connecting unit 11. The shape of the connecting unit 11 is not confined. In this embodiment, the connecting unit 11 is formed with an insertion hole 11 which has a shape illustrated in FIGS. 4(A) to 4(J). In one example, referring to FIG. 4, each of two ends of the handle 10 having a connecting unit for connecting various assembly so that the handle tool has various functions and thus the handle have two connecting units at two ends thereof. One connecting unit is formed with a recess; wherein a recess is an approximate round recess with six "⊓" shape grooves arranged around an edge of the recess (see FIG. 4(H)) and another connecting unit of the handle is formed with a pentagonal recess (see FIG. 4(J)).

Figure 1:
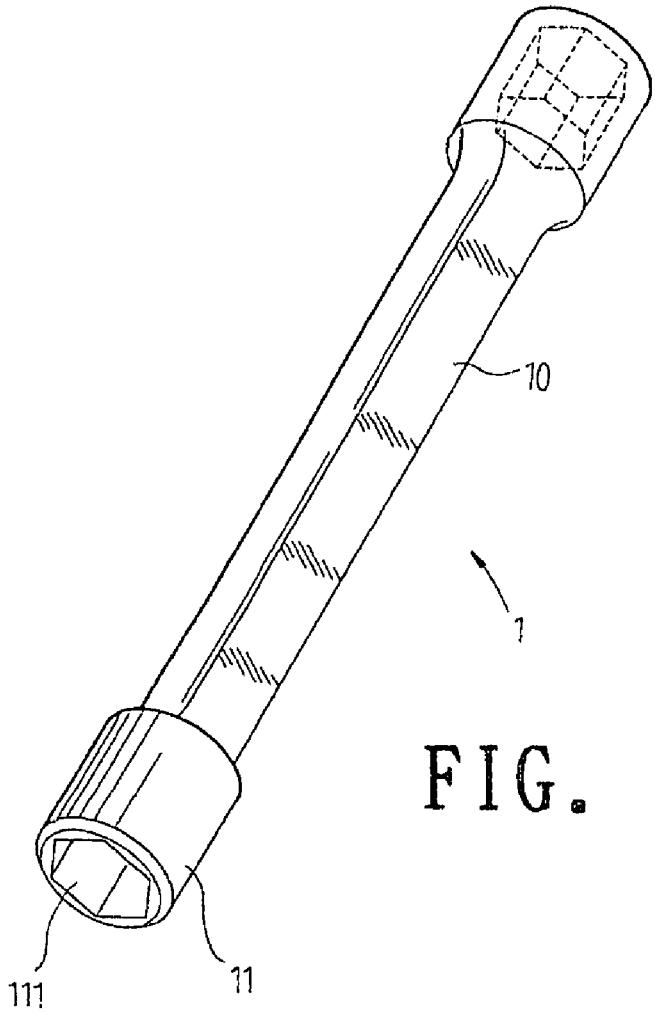
FIG. 1 is a perspective view of the multi-functional hand tool of the present invention.
Figure 2:
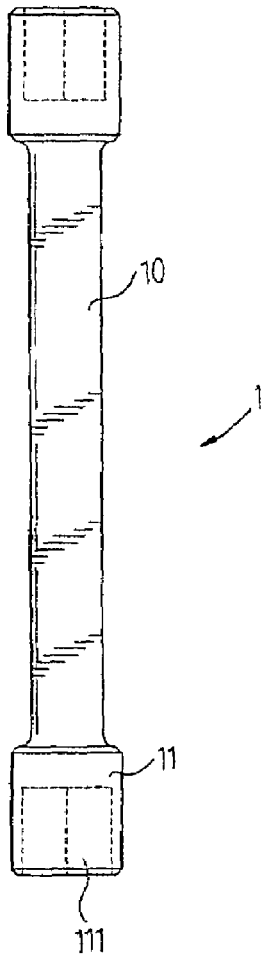
FIGS. 2 and 3 are lateral views of the multi-functional hand tool of the present invention.
Figure 3:
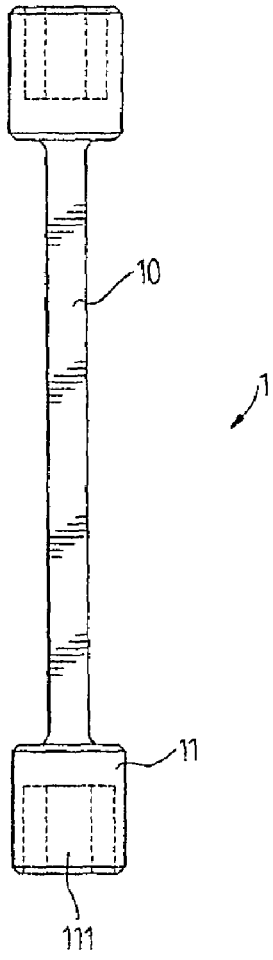
Figure 4A:
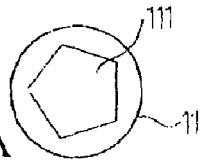
FIGS. 4(A) to 4(J) show the various forms of the insertion holes of the multi-functional hand tool of the present invention.
Figure 4B:
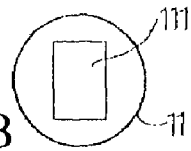
Figure 4C:
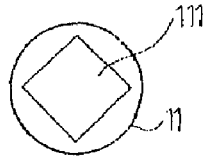
Figure 4D:
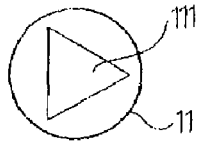
Figure 4E:
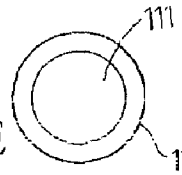
Figure 4F:
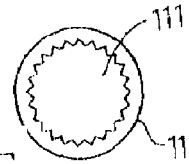
Figure 4G:
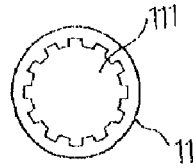
Figure 4H:
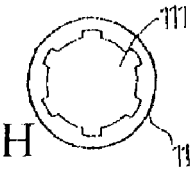
Figure 4I:
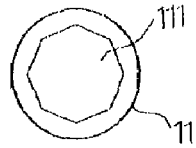
Figure 4J:
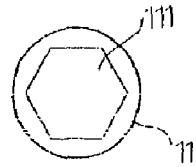
Figures 1, 2, 3, 5:
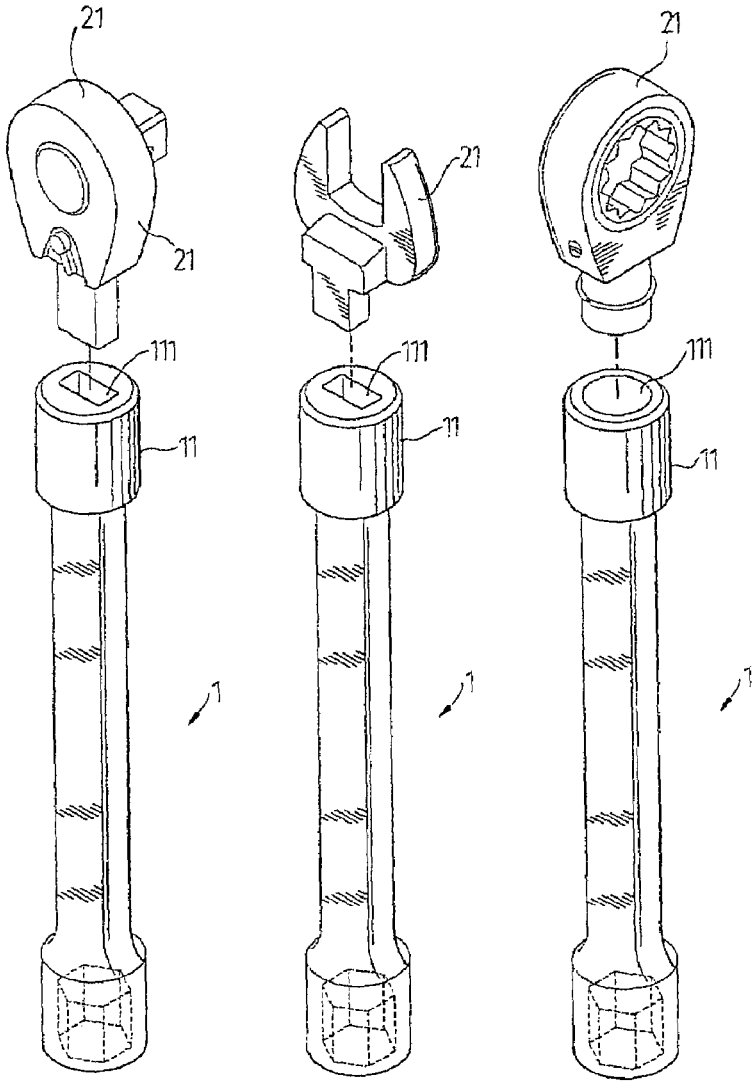
FIG. 5 shows that the multi-functional hand tool of the present invention is used with various driving heads.
Figure 8:
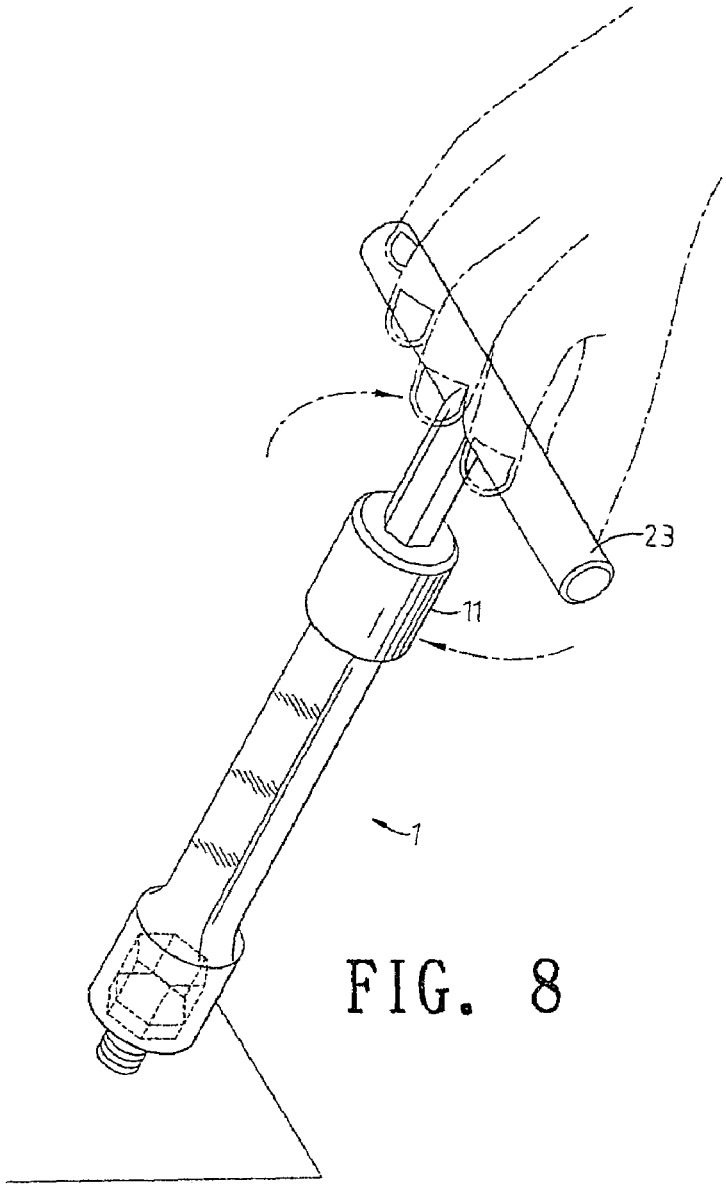
FIG. 8 shows one application of the present invention.

The application of the present invention is illustrated in FIGS. 5 and 8. A driving head 21 can be installed in the insertion hole 111. The driving head 21 may be a ratchet driving head 21 (referring to FIG. 5-1), an opened end driving head 21 (referring to FIG. 5-2), a socket driving head 21 (referring to FIG. 5-3), etc. Thus the multi-functional hand tool can be used with various driving heads 21 by using the insertion holes 111 at two ends thereof.

Figure 6:
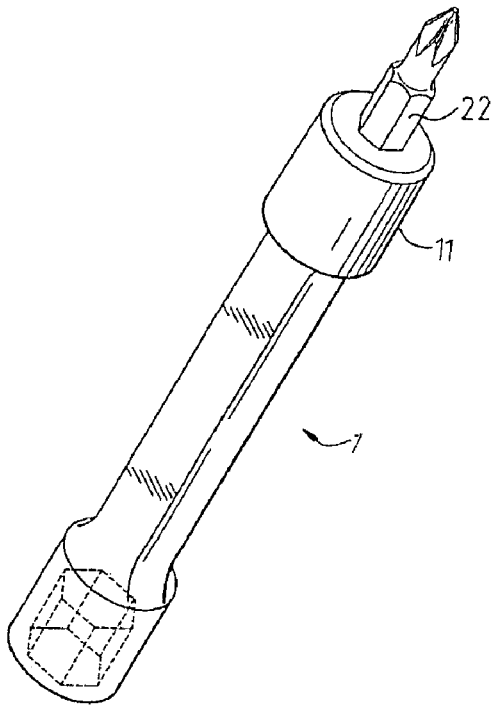
FIG. 6 shows that the multi-functional hand tool of the present invention is used with an opener head.
Figure 7:
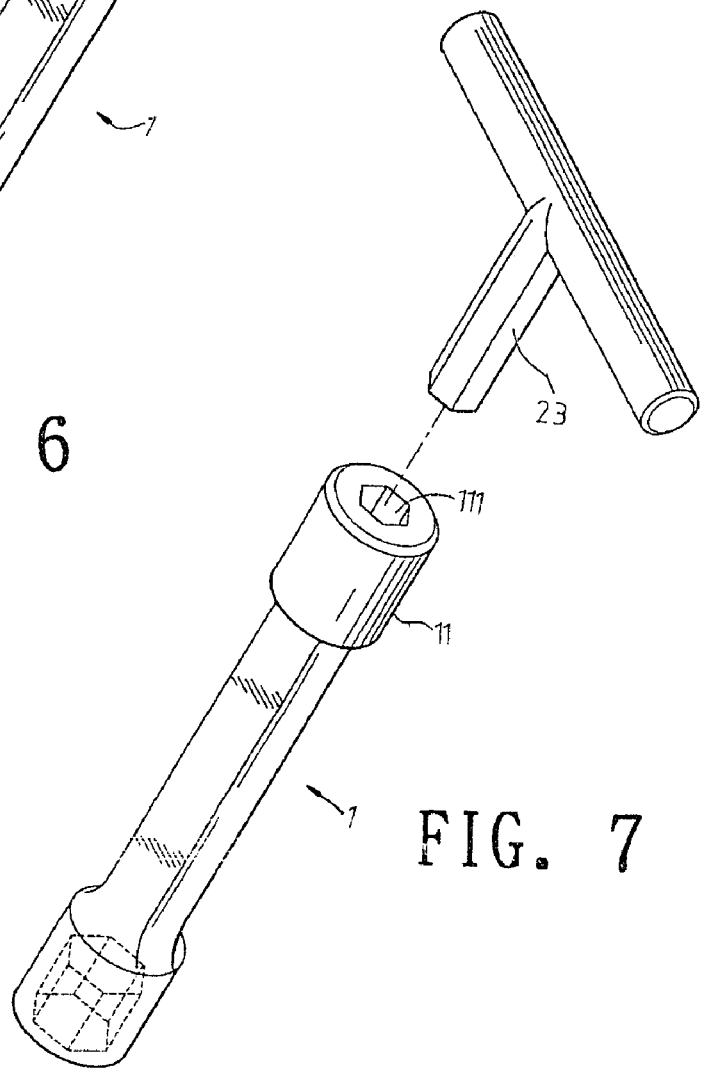
FIG. 7 shows that the multi-functional hand tool of the present invention is used with an auxiliary rotating unit.

Referring to FIGS. 6 and 7, the present invention can be used with different kinds of opener heads 22, 23. In FIG. 7, a T shape auxiliary rotating unit 23 is inserted into the insertion hole 111 at one end of the multi-functional hand tool (referring to FIG. 8) so as to provide a long arm of force. Thereby the multi-functional hand tool can be used to drive an object easily.

Figures 9, 10:
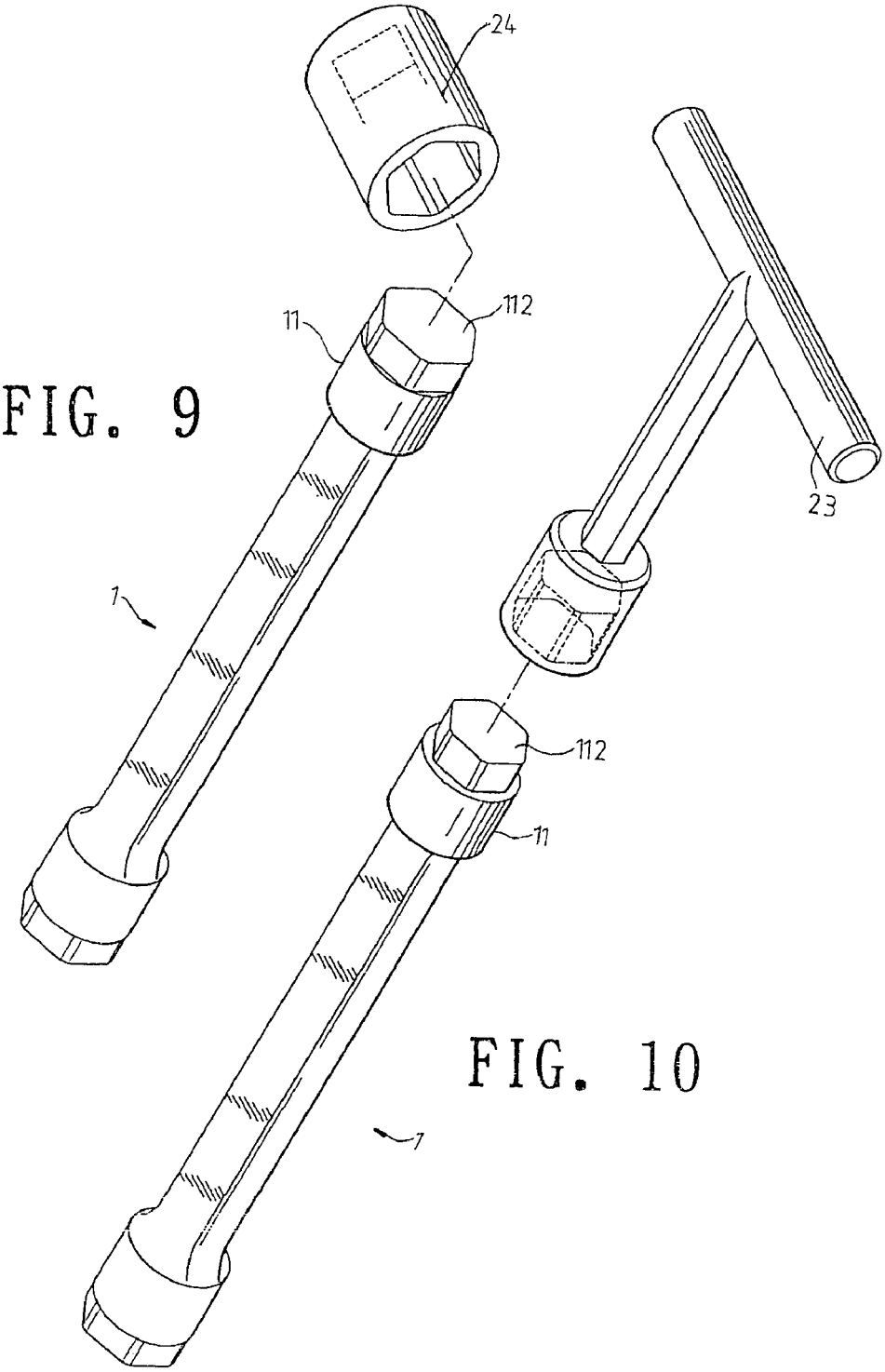
FIGS. 9 and 10 are schematic views of another embodiment of the present invention.

Referring to FIGS. 9 and 10, another embodiment of the present invention is illustrated. Those identical to the first embodiment will not be described herein. Only those differences are described herein. In this embodiment, the connecting unit 11 of the present invention can be realized as a polygonal connecting unit 112 for being connected to a socket or an auxiliary rotating unit 23, etc. so as to achieve the object of multi-function.

Figure 11:
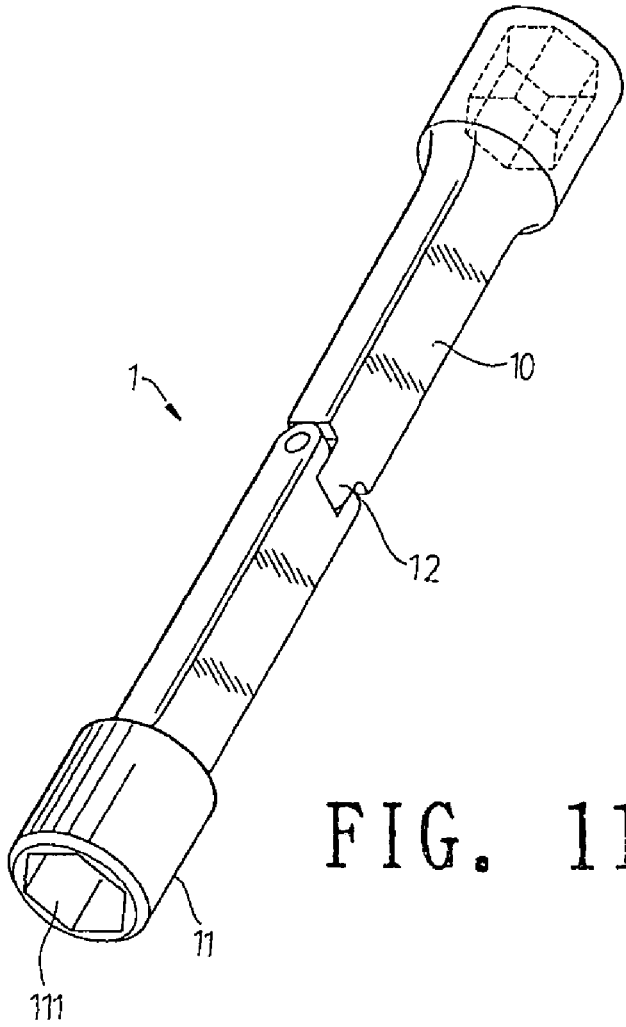
FIG. 11 is a perspective view of a further embodiment of the present invention.
Figure 12:
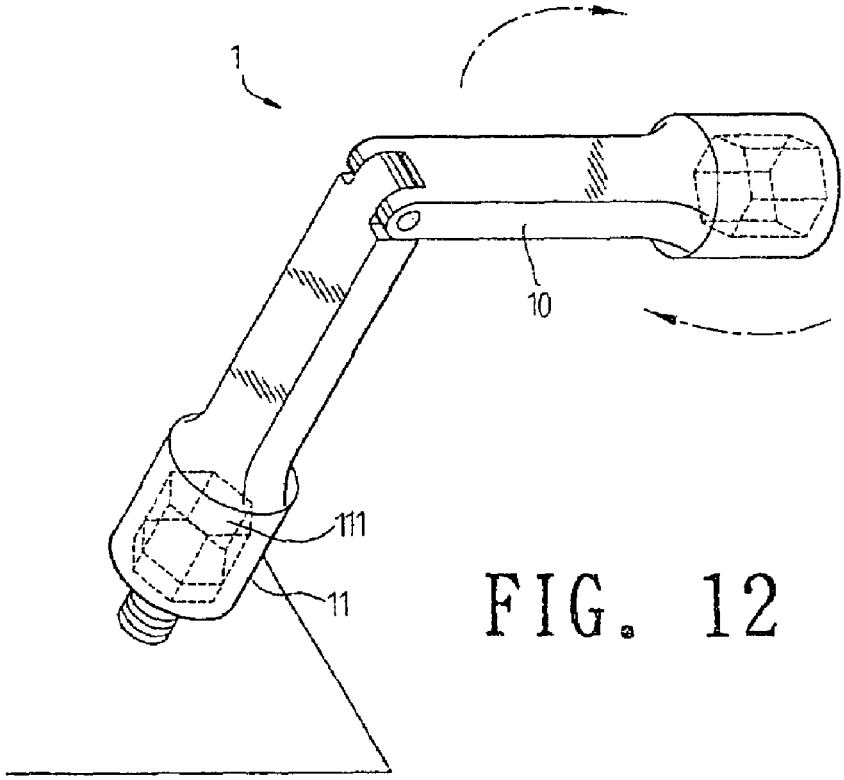
FIG. 12 is a perspective view of a yet embodiment of the present invention.

With reference to FIGS. 11 and 12, a further embodiment of the multi-functional hand tool of the present invention is illustrated. Those identical to the first embodiment will not be described herein. Only those differences are described herein. In this embodiment, the handle 10 is formed with a pivotal portion 12 so that the two connecting units 11 at two ends of the multi-functional hand tool can be pivotally rotated with respect to one another. Thereby the multi-functional hand tool can be used to various conditions. In FIG. 12, it is illustrated that a screw mean is inserted into the insertion hole 111 of the connecting unit 11. It is preferable that the pivotal portion 12 is installed at one third of the handle 10.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-functional hand tool comprising: a hand tool body which has a handle; each of two ends of the handle having a connecting unit for connecting various assembly so that the handle tool has various functions and thus the handle have two connecting units at two ends thereof;

wherein one connecting unit is formed with a recess; wherein a recess is an approximate round recess with six "⊓" shape grooves arranged around an edge of the recess and another connecting unit of the handle is formed with a pentagonal recess.

2. The multi-functional hand tool as claimed in claim 1, wherein the handle is formed with a pivotal portion.

3. The multi-functional hand tool as claimed in claim 2, wherein the pivotal portion is installed at one third of the handle.

* * * * *